US011217152B1

(12) United States Patent
Ma et al.

(10) Patent No.: US 11,217,152 B1
(45) Date of Patent: Jan. 4, 2022

(54) SOURCE DRIVER AND DRIVING CIRCUIT THEREOF

(71) Applicant: NOVATEK Microelectronics Corp., Hsin-Chu (TW)

(72) Inventors: Yu-Sheng Ma, Taichung (TW); Jhih-Siou Cheng, New Taipei (TW); Chun-Fu Lin, Taoyuan (TW); Tso-Sheng Chan, Kaohsiung (TW); Ren-Chieh Yang, Taichung (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 17/111,449

(22) Filed: Dec. 3, 2020

Related U.S. Application Data

(60) Provisional application No. 63/039,954, filed on Jun. 16, 2020.

(30) Foreign Application Priority Data

Aug. 26, 2020 (TW) ..... 109129127

(51) Int. Cl.
*G09G 3/32* (2016.01)

(52) U.S. Cl.
CPC ..... *G09G 3/32* (2013.01); *G09G 2300/06* (2013.01); *G09G 2300/08* (2013.01); *G09G 2310/0243* (2013.01); *G09G 2310/0275* (2013.01); *G09G 2310/0291* (2013.01); *G09G 2320/0233* (2013.01); *G09G 2330/025* (2013.01)

(58) Field of Classification Search
CPC ..... G09G 3/32
See application file for complete search history.

(56) References Cited

U.S. PATENT DOCUMENTS

| | | | | |
|---|---|---|---|---|
| 10,497,331 | B2 | 12/2019 | Hong | |
| 2002/0005696 | A1* | 1/2002 | Yamazaki | G09G 3/3233 315/169.3 |
| 2013/0141474 | A1 | 6/2013 | Kim | |
| 2019/0280655 | A1 | 9/2019 | Oulee | |

FOREIGN PATENT DOCUMENTS

| | | | |
|---|---|---|---|
| CN | 107180617 | A | 9/2017 |
| TW | 201501097 | A | 1/2015 |
| TW | 201537546 | A | 10/2015 |

* cited by examiner

*Primary Examiner* — Gustavo Polo
(74) *Attorney, Agent, or Firm* — Winston Hsu

(57) ABSTRACT

The present invention provides a source driver for driving a light emitting diode panel. The source driver includes a buffer including an output terminal; and a plurality of driving circuits coupled to the buffer. Each of the plurality of driving circuits includes a constant current transistor including a gate controlled by a node voltage of the output terminal of the buffer; and a compensation unit for compensating the node voltage of the output terminal of the buffer.

23 Claims, 7 Drawing Sheets

SOURCE DRIVER AND DRIVING CIRCUIT THEREOF

CROSS REFERENCE TO RELATED APPLICATIONS

This application claims the benefit of U.S. Provisional Application No. 63/039,954, filed on Jun. 16, 2020 and entitled "LED D-IC Design with Dynamic Coupling Compensation", the content of which is incorporated herein by reference.

BACKGROUND OF THE INVENTION

1. Field of the Invention

The present invention relates to a source driver and drive circuit thereof, and more particularly, to a source driver and drive circuit thereof capable of reducing impact of voltage coupling on channel current when a driving circuit is being turned on or off, to reduce channel current changes and luminance change.

2. Description of the Prior Art

In the art of light emitting diode (LED) driving, a passive matrix driving mode connects anodes (i.e. P-electrode) of light emitting diode pixels in each column of a matrix to each channel of light emitting diode source driver, while connecting cathodes (i.e. N-electrode) light emitting diode pixels in each row of the matrix to each scan line to a ground via each scan switch. When a specific column and a specific row are turned on, a light emitting diode pixel at the intersection emits light.

However, when a channel of the light emitting diode source driver is turned on, there are two coupling paths that affect other channels and thus affect brightness of light emitting diode pixels. In view of this, it is necessary to improve the conventional technology.

SUMMARY OF THE INVENTION

It is therefore an objective of the present invention to provide a source driver and drive circuit thereof capable of reducing impact of voltage coupling on channel current when a driving circuit is being turned on or off, to reduce channel current changes and luminance change.

The present invention discloses a source driver for driving a light emitting diode panel. The source driver includes a buffer including an output terminal; and a plurality of driving circuits coupled to the buffer. Each of the plurality of driving circuits includes a constant current transistor including a gate controlled by a node voltage of the output terminal of the buffer; and a compensation unit for compensating the node voltage of the output terminal of the buffer.

The present invention further discloses a driving circuit for driving a source driver of a light emitting diode (LED) panel. The driving circuit includes a constant current transistor, including a gate controlled by a node voltage of an output terminal of a buffer; and a compensation unit, for compensating the node voltage of the output terminal of the buffer.

These and other objectives of the present invention will no doubt become obvious to those of ordinary skill in the art after reading the following detailed description of the preferred embodiment that is illustrated in the various FIGS. and drawings.

DETAILED DESCRIPTION

The term "comprising" as used throughout the specification and subsequent claims is an open-ended fashion and should be interpreted as "including but not limited to". The descriptions of "first" and "second" mentioned in the entire specification and subsequent claims are only used to distinguish different components and do not limit the order of generation.

Figure 1:
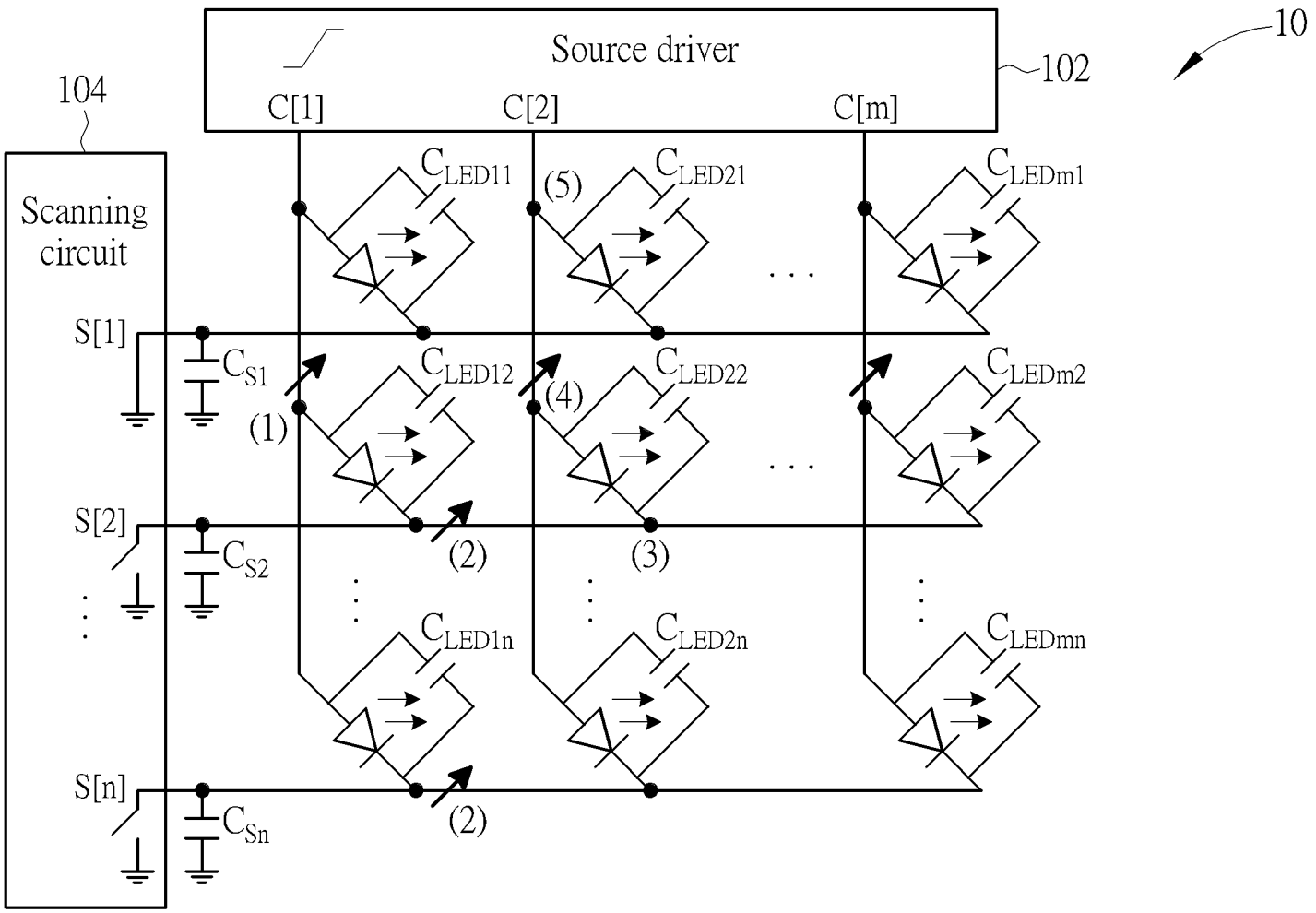
FIG. 1 is a schematic diagram of a light emitting diode panel with passive matrix driving.

Please refer to FIG. 1, which is a schematic diagram of a light emitting diode (LED) panel 10 with passive matrix driving. As shown in FIG. 1, the light emitting diode panel 10 includes a source driver 102, a scanning circuit 104, channels C[1]-C[m], scanning lines S[1]-S[n], and scanning capacitors $C_{S1}$-$C_{Sn}$, light emitting diode capacitors $C_{LED\ 11}$-$C_{LEDmn}$ and corresponding light emitting diodes. The source driver 102 drives the channels C[1]-C[m], and the scanning circuit 104 connects the scanning lines S[1]-S[n] to a ground via corresponding switches. The scanning capacitors $C_{S1}$-$C_{Sn}$ are utilized that no voltage difference is formed across the light emitting diodes when the scanning lines S[1]-S[n] are not grounded. When the scanning circuit 104 connects specific scanning lines of the scanning lines S[1]-S[n] to the ground and the source driver 102 drives a specific channel of the channels C[1]-C[m], a light emitting diode at the intersection can be turned on.

For example, when the scanning circuit 104 connects the scan line S[1] to the ground and the source driver 102 drives the channel C[1], a voltage difference is formed across the light emitting diode capacitor $C_{LED11}$ to conduct a corresponding light emitting diode. However, when the source driver 102 drives the channel C[1], a voltage change is coupled to other non-driven floating channel outputs via capacitive coupling paths on a light emitting diode board (e.g., coupled to the channel C[2] via nodes (1)>(2)>(3)>(4)>(5)). Meanwhile, the scan line S[1] is grounded, so that voltages across the light emitting diode capacitors $C_{LED21}$-$C_{LEDm1}$ are affected and thus conduction currents of the light emitting diodes are also affected. As a result, if more channels are being turned on at the same time, capacitive coupling on the LED board is stronger, resulting in greater impact on cross voltages, greater current change and greater brightness change.

Figure 2:
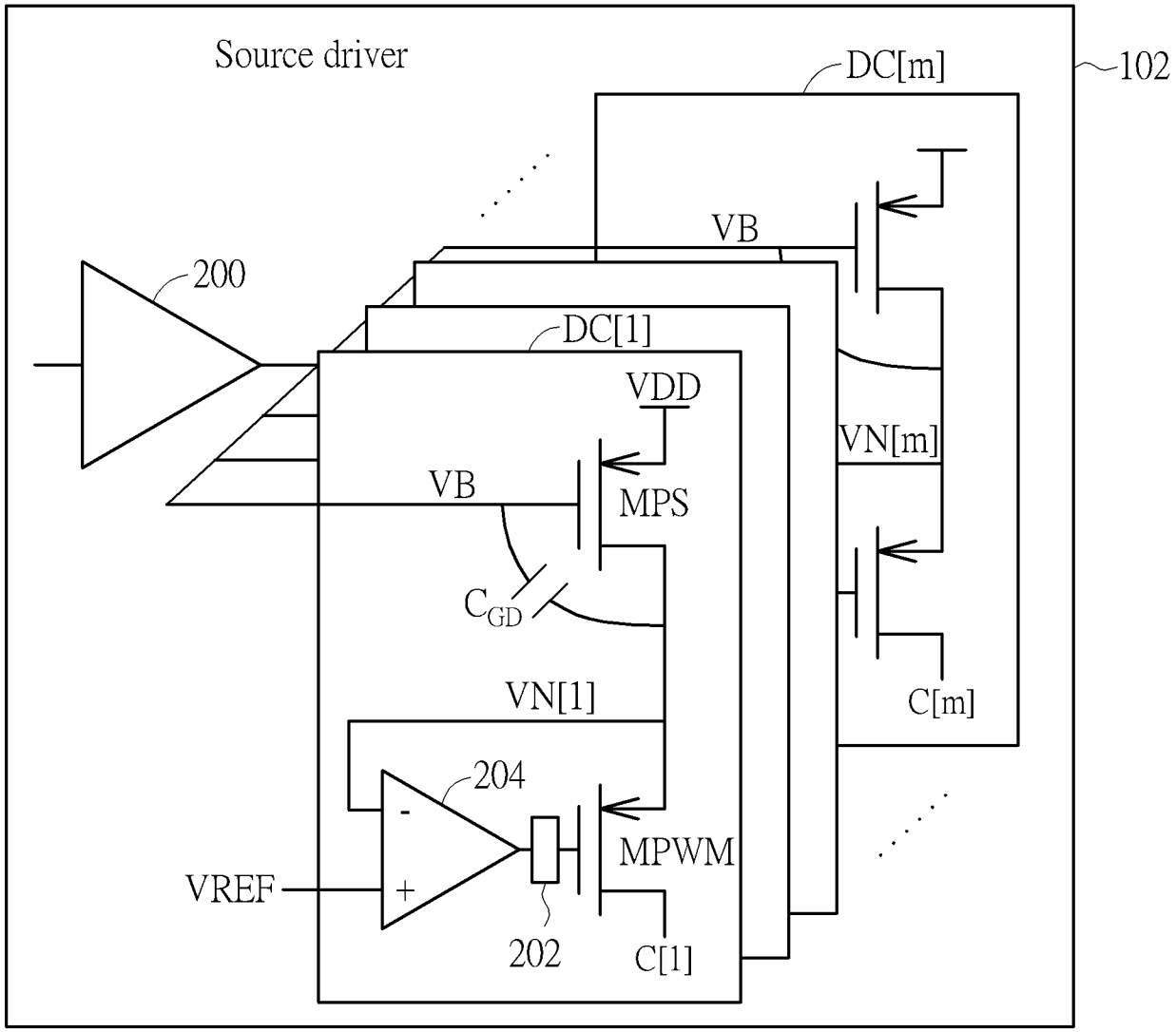
FIG. 2 is a schematic diagram of the source driver shown in FIG. 1.

On the other hand, please refer to FIG. 2, which is a schematic diagram of the source driver 102 shown in FIG. 1. As shown in FIG. 2, a node voltage VB of an output terminal of a buffer 200 controls the driving circuits DC[1]-DC[m] to drive the channels C[1]-C[m]. For example, in the driving circuit DC[1], a pulse width modulation (PWM) circuit 202 controls a pulse width modulation transistor MPWM to be turned on or off according to a pulse width modulation signal, to turn on or turn off the channel C[1]. Luminous brightness is determined by a pulse width of the pulse width modulation signal and a stable channel current provided by a constant current transistor MPS (i.e. a constant current source). When the pulse width modulation transistor MPWM is turned off, a node voltage VN[1] is instantaneously raised to a system voltage VDD, or when the pulse width modulation transistor MPWM is turned on, an amplifier 204 performs negative feedback and thus the node voltage VN[1] is instantaneously pulled down to a reference voltage VREF. Thus, the node voltage VB for a gate of the constant current transistor MPS is affected by voltage change of the node voltage VN[1] via a parasitic capacitor $C_{GD}$. In this case, since channel currents will be affected by operations of other channels, if more channels operate at the same time, voltage coupling is stronger, resulting in greater impact on the constant current source, greater current change and greater brightness change.

Figure 3:
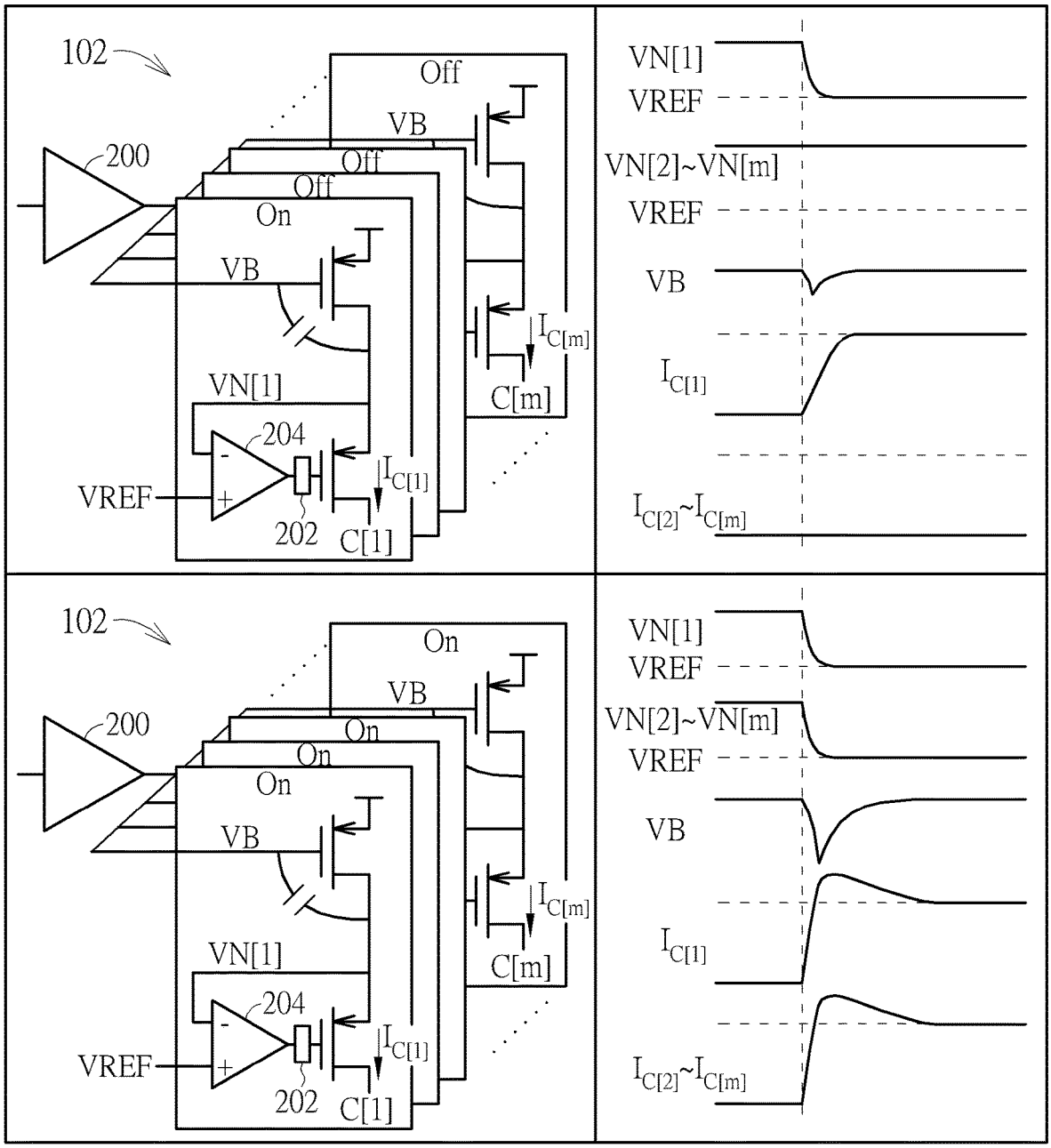
FIG. 3 is a schematic diagram of operation of the source driver shown in FIG. 2.

For example, please refer to FIG. 3, which is a schematic diagram of operation of the source driver 102 shown in FIG. 2. As shown in the upper half of FIG. 3, take the scan line S[1] conducted as an example, when only the channel C[1] is being turned on, the pulse width modulation transistor MPWM is being turned on and the node voltage VN[1] is pulled down to the reference voltage VREF, the node voltage VB is slightly coupled downward and an instantaneous current of a channel current $I_{C[1]}$ only slightly increases. On the other hand, as shown in the lower half of FIG. 3, when the channels C[1]-C[m] are all being turned on at the same time, the node voltage VB is significantly coupled downward and instantaneous currents of channel currents $I_{C[1]}$-$I_{C[m]}$ are increased substantially. In addition to the capacitive coupling paths on the board as shown in FIG. 1, current will significantly increase, so that brightness also changes significantly.

Figure 4:
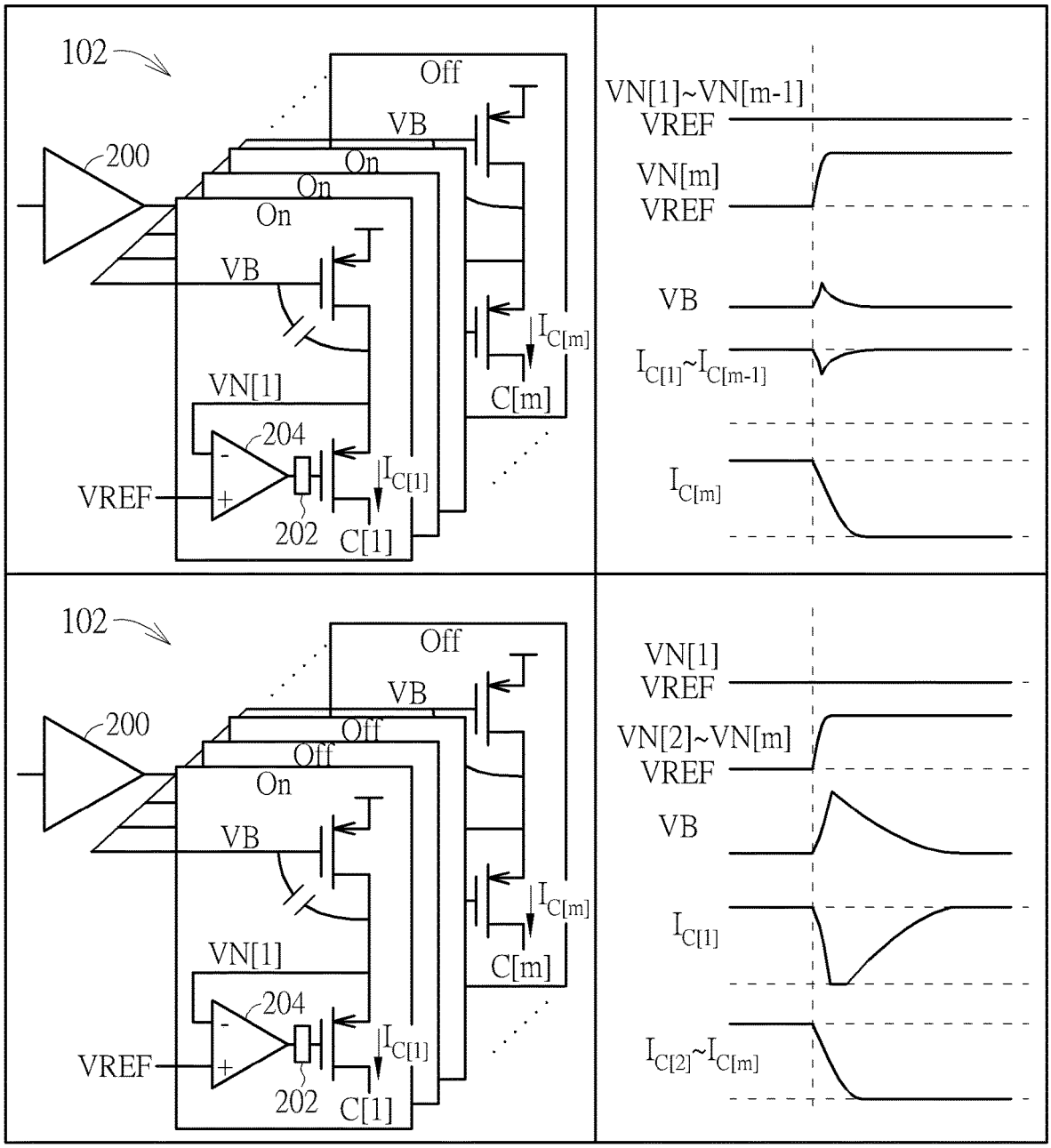
FIG. 4 is a schematic diagram of another operation of the source driver shown in FIG. 2.

On the other hand, please refer to FIG. 4, which is schematic diagram of another operation of the source driver 102 shown in FIG. 2. As shown in the upper half of FIG. 4, take the scan line S[1] conducted as an example, when the channels C[1]-C[m-1] remain turned on, the channel C[m] is being turned off, the corresponding pulse width modulation transistor MPWM is being turned off and the node voltage VN[m] is raised to the system voltage VDD, the node voltage VB is slightly coupled upward and instantaneous currents of the channel currents $I_{C[1]}$-$I_{C[m-1]}$ are reduced slightly. On the other hand, as shown in the lower half of FIG. 4, when only the channel C[1] remains turned on and the channels C[2]-C[m] are being turned off, the node voltage VB is significantly coupled upward, instantaneous current of the channel current $I_{C[1]}$ is reduced greatly, so that brightness also changes significantly.

Figure 5:
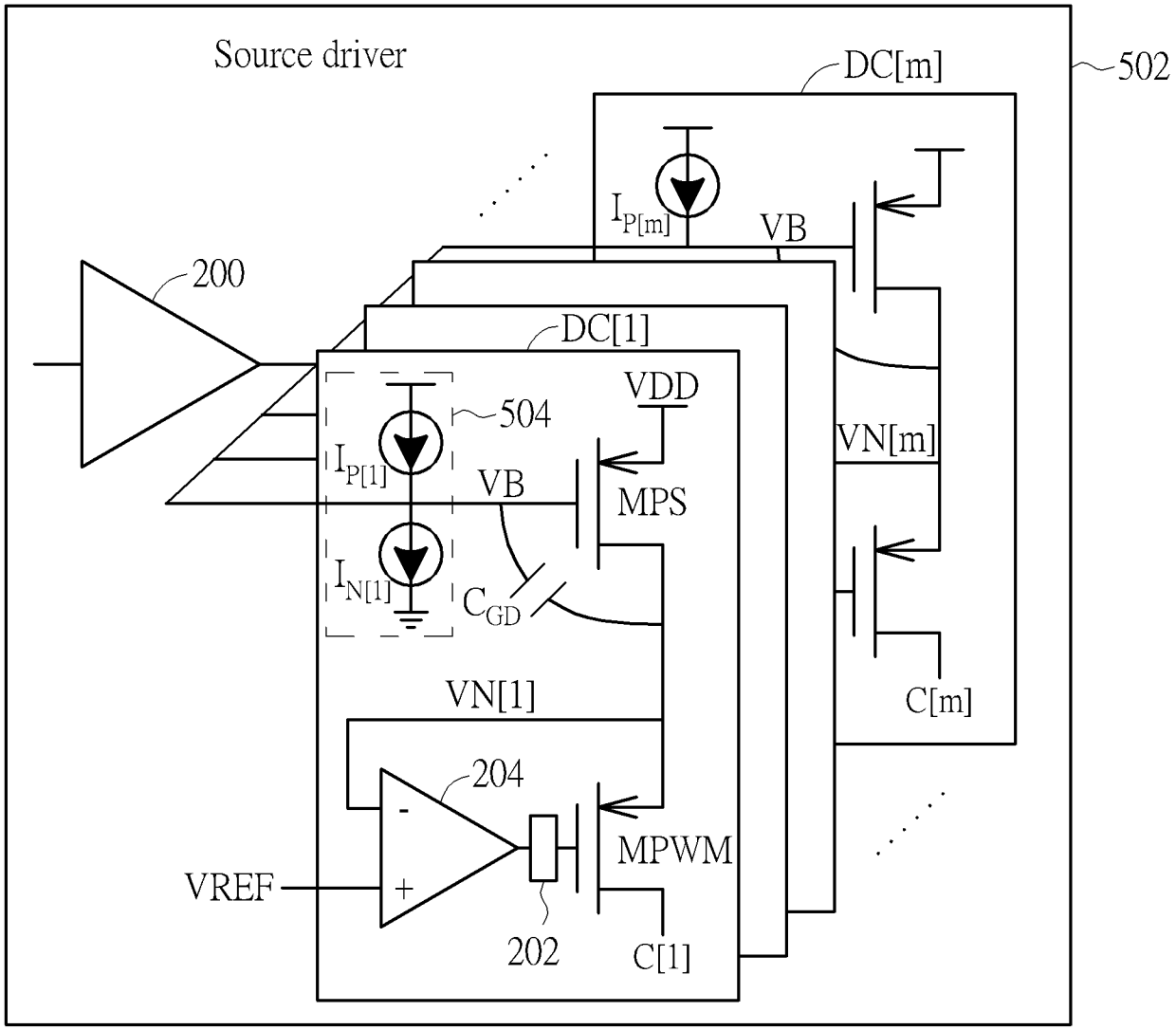
FIG. 5 is a schematic diagram of a source driver according to an embodiment of the present invention.

In contrast, please refer to FIG. 5, which is a schematic diagram of a source driver 502 according to an embodiment of the present invention. The source driver 502 may replace the source driver 102 shown in FIG. 2 to implement the source driver 102 shown in FIG. 1. The source driver 502 is similar to the source driver 102, so components with similar functions and structures are denoted by the same symbols. The main difference between the source driver 502 and the source driver 102 shown in FIG. 2 is that each of the driver circuits DC[1]-DC[m] in the source driver 502 further includes a compensation unit 504 for compensating the node voltage VB of the output terminal of the buffer 200 when at least one driving circuit is being turned on or off. Specifically, when at least one driving circuit is being turned on, the compensation unit 504 raises the node voltage VB of the output terminal of the buffer 200, and when at least one driving circuit is being turned off, the compensation unit 504 reduces the node voltage VB of the output terminal of the buffer 200. For example, the compensation unit 504 in the driving circuit DC[1] may include compensation circuits $I_{P[1]}$ and $I_{N[1]}$ for raising and reducing the node voltage VB, respectively, wherein the compensation circuits $I_{P[1]}$ and $I_{N[1]}$ are illustrated as current sources in FIG. 5. In addition, the compensation unit 504 may compensate the node voltage VB of the gate of a corresponding constant current transistor MPS when a corresponding drive circuit is being turned on or off, but the compensation unit 504 may compensate the node voltage VB of the gate of a corresponding constant current transistor MPS when other drive circuits are being turned on or off.

Figure 6:
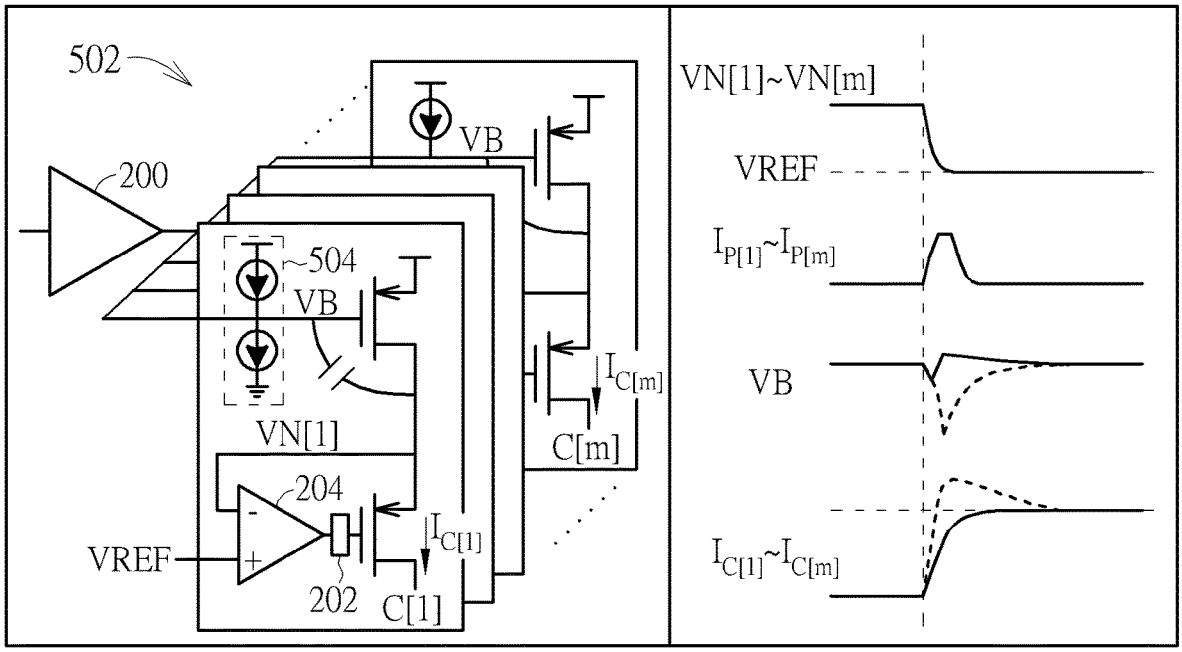
FIG. 6 is a schematic diagram of operation of the source driver shown in FIG. 5 according to an embodiment of the present invention.

In detail, please refer to FIG. 6, which is a schematic diagram of operation of the source driver 502 shown in FIG. 5 according to an embodiment of the present invention. As shown in FIG. 6, when the channels C[1]-C[m] are all being turned on at the same time (that is, at least one drive circuit and at least one corresponding channel are being turned on), the compensation circuits $I_{P[1]}$-$I_{P[m]}$ outputs currents in synchronization with outputs of at least one channels, wherein output time lengths of the compensation circuit $I_{P[1]}$-$I_{P[m]}$ may be adjusted to raise the node voltage VB to compensate for the voltage drop due to coupling of the node voltages VN[1]-VN[m] (compared with the lower half of FIG. 3, the embodiment of the present invention may reduce variation of the node voltage VB from a dashed line to a solid line, so as to reduce variation of the channel currents $I_{C[1]}$-$I_{C[m]}$ from a dashed line to a solid line). It should be noted that if more channels are being turned on at the same time, capacitive coupling on the LED board is stronger, but the compensation circuits $I_{P[1]}$-$I_{P[m]}$ corresponding to more channels compensate for the node voltage VB more, so as to compensate cooperatively to reduce channel current changes and brightness changes.

Figure 7:
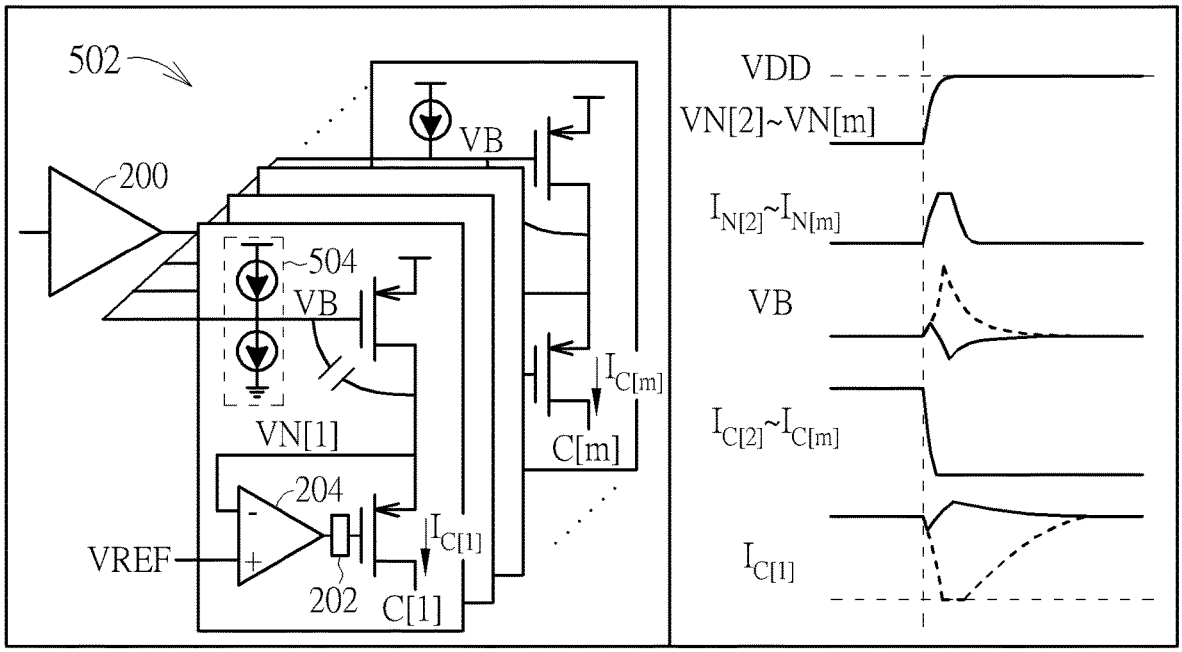
FIG. 7 is a schematic diagram of another operation of the source driver shown in FIG. 5 according to an embodiment of the present invention.

On the other hand, please refer to FIG. 7, which is a schematic diagram of another operation of the source driver 502 shown in FIG. 5 according to an embodiment of the present invention. As shown in FIG. 7, when the channel C[1] remains turned on and the channels C[2]-C[m] are being turned off (that is, at least one drive circuit and at least one corresponding channel are being turned off), the compensation circuits $I_{N[2]}$-$I_{N[m]}$ output currents after the channels are being turned off, wherein output time lengths of the compensation circuits $I_{N[2]}$-$I_{N[m]}$ may be adjusted to reduce the node voltage VB to compensate for the voltage raise due to coupling of the node voltages VN[2]-VN[m] (compared with the lower half of FIG. 4, the embodiment of the present invention may reduce variation of the node voltage VB from a dashed line to a solid line, so as to reduce variation of the channel current $I_{C[1]}$ from a dashed line to a solid line). It should be noted that if more channels are being turned off at the same time, capacitive coupling on the LED board is stronger, but the compensation circuits $I_{N[2]}$-$I_{N[m]}$ corresponding to more channels compensate for the node voltage VB more, so as to compensate cooperatively to reduce channel current changes and brightness changes.

It is worth noting that the embodiment of the present invention compensates the node voltage VB of the output terminal of the buffer 200 to reduce the influence of voltage coupling on the channel current when at least one driving circuit is being turned on or off, so as to reduce the channel current change and the brightness change. Those skilled in the art may make modifications or alterations accordingly, but not limited to this. For example, FIG. 5 illustrates the compensation circuits $IP_{[1]}$ and $IN_{[1]}$ as current sources, but the compensation circuits $IP_{[1]}$ and $IN_{[1]}$ may be realized by comprising one of a metal oxide semiconductor field effect transistor, a diode, a source follower, an operational amplifier or a current source.

Figure 8:
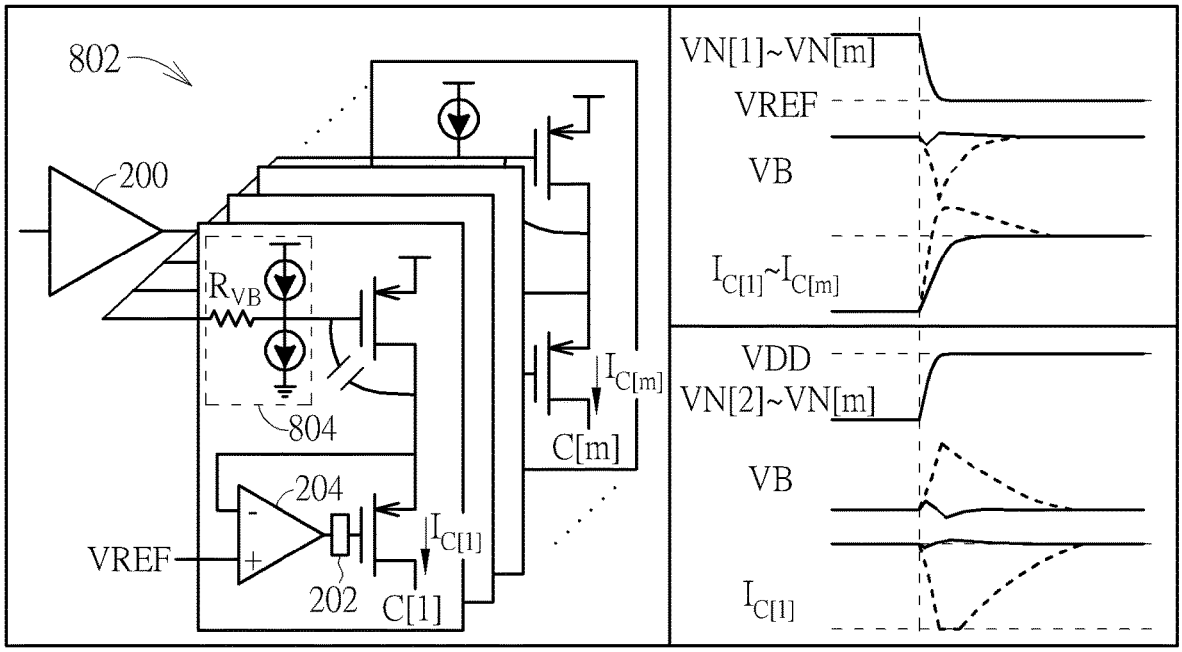
FIG. 8 is a schematic diagram of another source driver according to an embodiment of the present invention.

On the other hand, the compensation unit may further include other components. For example, please refer to FIG. 8, which is a schematic diagram of operations of a source driver 802 according to an embodiment of the present invention. The source driver 802 may replace the source driver 102 shown in FIG. 2 to implement the source driver 102 shown in FIG. 1. The source driver 802 is similar to the source driver 502, so components with similar functions and structures are denoted by the same symbols. The main difference between the source driver 802 and the source driver 502 is that a compensation unit 804 included in each of the driving circuits DC[1]-DC[m] in the source driver 802 further includes a resistor $R_{VB}$ coupled between the output terminal of the buffer 200 and the gate of the constant current transistor MPS, to greatly reduce coupling from the node voltage VN to the node voltage VB (the resistor $R_{VB}$ may function as a resistance capacitor filter (RC filter) to isolate the coupling from the node voltage VN to the node voltage VB), thereby reducing the influence of voltage coupling on other channels when the channel is being turned on or off. In this case, compared with the lower half of FIG. 3, as shown in the upper right of FIG. 8, the embodiment of the present invention may reduce variation of the node voltage VB from a dashed line to a solid line (smaller variation than the solid line in FIG. 6), to reduce variation of the channel current $I_{C[1]}$-$I_{C[m]}$ from a dashed line to a solid line (smaller variation than the solid line in FIG. 6), so as to reduce brightness change. In addition, compared with the lower half of FIG. 4, as shown in the lower right of FIG. 8, the embodiment of the present invention may reduce variation of the node voltage VB from a dashed line to a solid line (smaller variation than the solid line in FIG. 7), to reduce variation of the channel current $I_{C[1]}$ from a dashed line to a solid line (smaller variation than the solid line in FIG. 7), so as to reduce brightness change.

Figure 9:
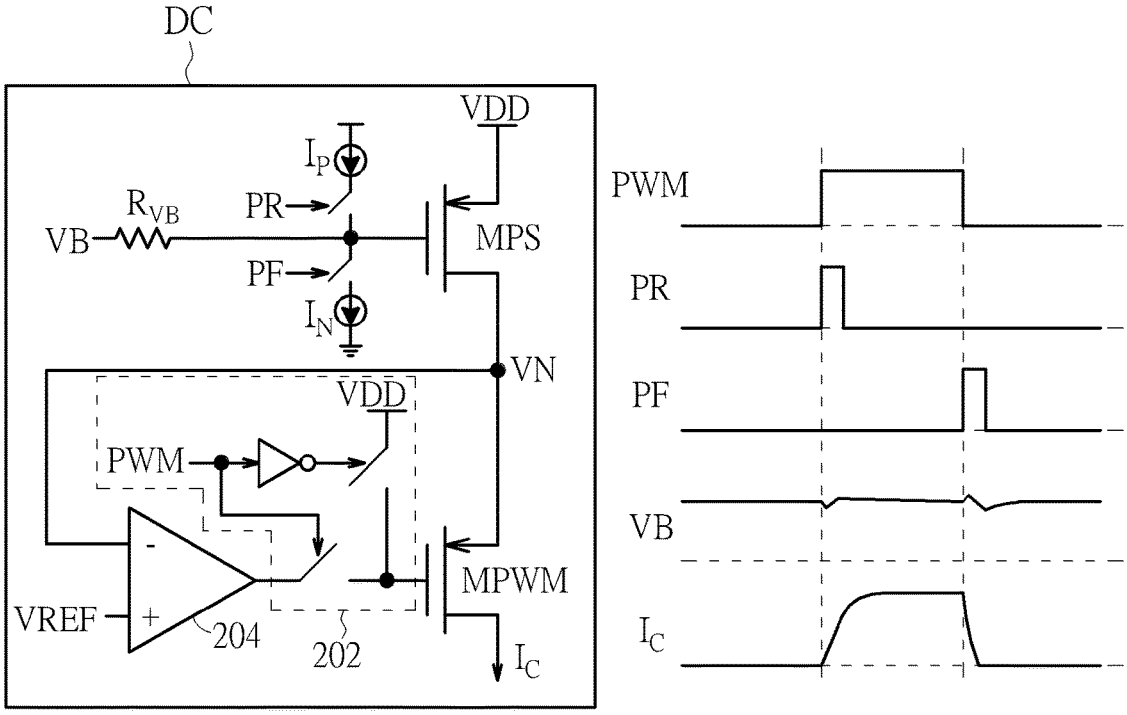
FIG. 9 is a schematic diagram of operation of another drive circuit according to an embodiment of the present invention.

On the other hand, the pulse width modulation circuit 202 may be implemented in any form. For example, please refer to FIG. 9, which is a schematic diagram of operations of a driving circuit DC according to an embodiment of the present invention. The driving circuit DC may be any one of the driving circuits DC[1]-DC[m] shown in FIG. 8. As shown in FIG. 9, the pulse width modulation circuit 202 controls a pulse width modulation transistor MPWM to be turned on or off according to a pulse width modulation signal PWM. A pulse width modulation circuit 202 receives the pulse width modulation signal PWM and generates an inverse signal via an inverter. A switch is coupled between a voltage VDD and the gate of the pulse width modulation transistor MPWM, and is controlled by the inverted signal, to control the gate of the pulse width modulation transistor MPWM to be at a high level (e.g. the system voltage VDD) and turned off when the pulse width modulation signal PWM is at a low level. The pulse width modulation circuit 202 further includes another switch coupled between an output terminal of the amplifier 204 and the gate of the pulse width modulation transistor MPWM, and is controlled by the pulse width modulation signal PWM, to form a negative feedback loop to lock a source voltage (i.e. a node voltage VN) of the pulse width modulation transistor MPWM at a reference voltage VREF when the pulse width modulation signal PWM is at a high level. When the pulse width modulation signal PWM is switched from a low level to a high level, a control signal PR controls a compensation circuit $I_P$ (to provide current) to raise the node voltage VB for compensation. When the pulse width modulation signal PWM is switched from the high level to the low level, a control signal PF controls a compensation circuit $I_N$ (to drain current) to reduce the node voltage VB for compensation. Other operations may be derived by referring to the above description, which will not be narrated here for brevity.

In summary, the present invention compensates the node voltage of the output terminal of the buffer when at least one driving circuit is being turned on or off, so as to reduce the influence of voltage coupling on the channel current, thereby reducing the channel current change and brightness change.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A source driver, for driving a light emitting diode (LED) panel, comprising:

a buffer, comprising an output terminal; and a plurality of driving circuits, coupled to the buffer, wherein each driving circuit of the plurality of driving circuits comprises:

a constant current transistor, comprising a gate controlled by a node voltage of the output terminal of the buffer; and a compensation unit, for compensating the node voltage of the output terminal of the buffer, wherein the compensation units of the plurality of driving circuits are connected to the output terminal of the buffer.

2. The source driver of claim 1, wherein the compensation unit raises the node voltage of the output terminal of the buffer when at least one first driving circuit of the plurality of the driving circuits is being turned on.

3. The source driver of claim 1, wherein the compensation unit reduces the node voltage of the output terminal of the buffer when at least one second driving circuit of the plurality of the driving circuits is being turned off.

4. The source driver of claim 1, wherein the compensation unit comprises:

a first compensation circuit, for raising the node voltage of the output terminal of the buffer when the at least one first driving circuit of the plurality of driving circuits is being turned on; and a second compensation circuit, for reducing the node voltage of the output terminal of the buffer when the at least one second driving circuit of the plurality of driving circuits is being turned off.

5. The source driver of claim 4, wherein the first compensation circuit and the second compensation circuit are realized by comprising one of a metal oxide semiconductor field effect transistor, a diode, a source follower, an operational amplifier or a current source.

6. The source driver of claim 1, wherein the compensation unit compensates the node voltage of the output terminal of the buffer when the each driving circuit is being turned on or off.

7. The source driver of claim 1, wherein a compensation amount of compensation units of the plurality of driving circuits is more when a number of being turned on or off driving circuits among the plurality of driving circuits is more.

8. The source driver of claim 1, wherein the compensation unit further comprises a resistor coupled between the output terminal of the buffer transistor and the gate of the constant current transistor.

9. The source driver of claim 1, wherein the each driving circuit further comprises a pulse width modulation circuit, for controlling a pulse width modulation transistor to be turned on or off according to a pulse width modulation signal.

10. The source driver of claim 9, wherein the pulse width modulation circuit comprises:

an inverter, for receiving the pulse width modulation signal, to generate an inverted signal; and a first switch, coupled between a system voltage and a gate of the pulse width modulation transistor, for being controlled by the inverted signal, to control a gate of the pulse width modulation transistor to be at a high level and turned off when the pulse width modulation signal is at a low level.

11. The source driver of claim 9, wherein the pulse width modulation circuit comprises:

a second switch, coupled between an output terminal of an amplifier and a gate of the pulse width modulation transistor, for being controlled by the pulse width modulation signal, to form a negative feedback loop to lock a source voltage of the pulse width modulation transistor at a reference voltage when the pulse width modulation signal is at a high level.

12. The source driver of claim 9, wherein when the pulse width modulation signal is switched from a low level to a high level, a first control signal controls a first compensating circuit to raise the node voltage of the output terminal of the buffer, or when the pulse width modulation signal is switched from the high level to the low level, a second control signal controls a second compensation circuit to reduce the node voltage of the output terminal of the buffer.

13. A driving circuit, for driving a source driver of a light emitting diode (LED) panel, comprising:

a constant current transistor, comprising a gate controlled by a node voltage of an output terminal of a buffer; and a compensation unit, for compensating the node voltage of the output terminal of the buffer, wherein the compensation unit of the driving circuit is connected to the output terminal of the buffer and other compensation units of other driving circuits.

14. The driving circuit of claim 13, wherein the compensation unit raises the node voltage of the output terminal of the buffer when the driving circuit is being turned on.

15. The driving circuit of claim 13, wherein the compensation unit reduces the node voltage of the output terminal of the buffer when the driving circuit is being turned off.

16. The driving circuit of claim 13, wherein the compensation unit comprises:

a first compensation circuit, for raising the node voltage of the output terminal of the buffer when the driving circuit is being turned on; and a second compensation circuit, for reducing the node voltage of the output terminal of the buffer when the driving circuit is being turned off.

17. The driving circuit of claim 16, wherein the first compensation circuit and the second compensation circuit are realized by comprising one of a metal oxide semiconductor field effect transistor, a diode, a source follower, an operational amplifier or a current source.

18. The driving circuit of claim 13, wherein the compensation unit compensates the node voltage of the output terminal of the buffer when the driving circuit is being turned on or off.

19. The driving circuit of claim 13, wherein the compensation unit further comprises a resistor coupled between the output terminal of the buffer transistor and the gate of the constant current.

20. The driving circuit of claim 13 further comprising a pulse width modulation circuit, for controlling a pulse width modulation transistor to be turned on or off according to a pulse width modulation signal.

21. The driving circuit of claim 20, wherein the pulse width modulation circuit comprises:

an inverter, for receiving the pulse width modulation signal, to generate an inverted signal; and a first switch, coupled between a system voltage and a gate of the pulse width modulation transistor, for being controlled by the inverted signal, to control a gate of the pulse width modulation transistor to be at a high level and turned off when the pulse width modulation signal is at a low level.

22. The driving circuit of claim 20, wherein the pulse width modulation circuit comprises:

a second switch, coupled between an output terminal of an amplifier and a gate of the pulse width modulation transistor, for being controlled by the pulse width modulation signal, to form a negative feedback loop to lock a source voltage of the pulse width modulation transistor at a reference voltage when the pulse width modulation signal is at a high level.

23. The driving circuit of claim 20, wherein when the pulse width modulation signal is switched from a low level to a high level, a first control signal controls a first compensating circuit to raise the node voltage of the output terminal of the buffer, or when the pulse width modulation signal is switched from the high level to the low level, a second control signal controls a second compensation circuit to reduce the node voltage of the output terminal of the buffer.

* * * * *